US010597980B2

(12) United States Patent
Hernandez

(10) Patent No.: US 10,597,980 B2
(45) Date of Patent: Mar. 24, 2020

(54) EXTERNAL TRAP APPARATUS AND METHOD FOR SAFELY CONTROLLING TOOL STRING ASSEMBLIES

(71) Applicant: Michael Hernandez, Inez, TX (US)

(72) Inventor: Michael Hernandez, Inez, TX (US)

( * ) Notice: Subject to any disclaimer, the term of this patent is extended or adjusted under 35 U.S.C. 154(b) by 56 days.

(21) Appl. No.: 15/120,714

(22) PCT Filed: Dec. 19, 2014

(86) PCT No.: PCT/US2014/071431

§ 371 (c)(1),
(2) Date: Aug. 22, 2016

(87) PCT Pub. No.: WO2015/095668

PCT Pub. Date: Jun. 25, 2015

(65) Prior Publication Data

US 2017/0138156 A1 May 18, 2017

Related U.S. Application Data

(60) Provisional application No. 62/088,767, filed on Dec. 8, 2014, provisional application No. 61/919,727, filed on Dec. 21, 2013.

(51) Int. Cl.

| | |
|---|---|
| ***E21B 17/07*** | (2006.01) |
| ***E21B 41/00*** | (2006.01) |
| ***E21B 19/10*** | (2006.01) |
| *E21B 47/01* | (2012.01) |

(52) U.S. Cl.
CPC ..... *E21B 41/0021* (2013.01); *E21B 17/07* (2013.01); *E21B 19/10* (2013.01); *E21B 47/01* (2013.01)

(58) Field of Classification Search
CPC ..... E21B 17/07; E21B 19/10; E21B 41/0021; E21B 47/01; F16L 3/00; F16L 3/01; F16L 3/18
See application file for complete search history.

(56) References Cited

U.S. PATENT DOCUMENTS 2,563,851 A * 8/1951 Lundeen ..... E21B 19/07 175/423
3,748,702 A * 7/1973 Brown ..... E21B 19/10 188/67

(Continued)

*Primary Examiner* — Robert E Fuller
*Assistant Examiner* — Christopher J Sebesta
(74) *Attorney, Agent, or Firm* — M. Susan Spiering; Ferrells, PLLC

(57) ABSTRACT

An external trap apparatus (70) and a method for safely controlling drilling tool string components during oil field drilling operations includes a collar clamp (72) affixed to a drilling tool string lubricator (80) and configured with laterally spaced first and second vertical rails (120, 122) depending therefrom and configured to support a coaxially aligned guide plate (232) and a reinforced catcher plate assembly (164) carrying a tool-end receiving funnel receptacle (202) and first and second energy absorbing crush cylinders (160, 162). When the drill string (82) is raised or withdrawn from the well (28), the funnel receptacle (202) can be rotated into coaxial alignment to catch the drill string's end or downhole tool, in the event of an inadvertent loss of control of the drill string (82).

12 Claims, 20 Drawing Sheets

(56) References Cited

U.S. PATENT DOCUMENTS

| | | | | |
|---|---|---|---|---|
| 5,265,683 | A * | 11/1993 | Krasnov | E21B 3/02 173/164 |
| 5,687,962 | A * | 11/1997 | Goodrich | B23Q 1/52 269/310 |
| 7,384,077 | B2 * | 6/2008 | Niven | E21B 19/06 166/77.52 |
| 2007/0144730 | A1 | 6/2007 | Shahin et al. | |
| 2007/0193751 | A1 * | 8/2007 | Pietras | E21B 19/00 166/380 |
| 2011/0114391 | A1 | 5/2011 | Scheider | |
| 2011/0260480 | A1 * | 10/2011 | Scheider | E21B 19/07 294/102.2 |

* cited by examiner

Section D-D

Detail 2

Detail 1

Section A-A

Detail A

Section B-B

Section A-A

EXTERNAL TRAP APPARATUS AND METHOD FOR SAFELY CONTROLLING TOOL STRING ASSEMBLIES

CROSS-REFERENCE TO RELATED APPLICATIONS

This is a Continuation application which claims priority under 35 USC 120 and 35 USC 111(a) as the U.S. National Phase under 35 USC 371 of PCT/US14/71431, filed 19 Dec. 2014, published in English as WO 2015/095668 on 25 Jun. 2015 and also claims priority to (a) U.S. provisional patent application 62/088,767 filed 8 Dec. 2014 (entitled "External Trap Apparatus and Method for Safely Controlling Drill String Assemblies") and (b) U.S. provisional patent application 61/919,727 filed 21 Dec. 2013 (entitled "External Trap for Drilling Tool Strings") the entire disclosures of which are expressly incorporated herein by reference.

BACKGROUND OF THE INVENTION

Field of the Invention

The present invention relates to equipment for use in drilling and finishing hydrocarbon recovery wells, to drill and tool string apparatus, to drilling methods and, more particularly, to safety mechanisms and methods for the prevention of damage due to an unintended release of a well drilling tool, drill string, tool string, or like equipment used at a wellhead site.

Discussion of the Prior Art

As is known in the art, the recovery of oil or other hydrocarbons from underground is commonly accomplished by means of a borehole, or well, which is drilled to reach a deposit. Drilling operations typically use a directional boring tool having a cutting head which incorporates drilling controls in communication with drilling controllers at the surface. The cutting head is threadedly attached to the distal end of a hollow drill rod or drill pipe which consists of various downhole components, including, for example, a bent sub for directional control, as well as an elongated string of steel drill pipe segments threadedly connected end-to-end, with each segment typically being ten (10) meters in length. Rotational motion may be imparted to the drill head by a downhole hydraulic motor or by rotating the drill string from the earth's surface to drive the boring tool with its cutting head and attached bit.

As is known, as the drill bit is rotated, a suitable drilling fluid, or mud, is pumped downwardly inside the hollow drill string and exits out of the cutting head, flowing out around the bit and upwardly in the drilled well in the annular space around the outside of the drill string to transport material loosened by the bit upwardly and out of the borehole at the well head. As the bit advances down the borehole, sections of drill pipe are added to the surface or proximal end of the drill string assembly to gradually lengthen it during the drilling.

Conventional directional drilling allows the borehole to be drilled to great depths, or to be directed downwardly and then horizontally away from the well head to reach the deposits being sought. As the well is drilled, a suitable casing is installed to preserve the integrity of the borehole. Periodically, the drill bit and cutting head are withdrawn from the borehole for servicing or to permit various tools such as surveying equipment to be inserted into the well, and in such a circumstance the sections of drill pipe are disconnected sequentially as the string is lifted out. Upon completion of the drilling and casing operation, it is often necessary to finish the well, as by perforating the well casing at the location of the hydrocarbon deposit, to allow fluid communication between the producing formation and the interior of the well casing. Perforations are usually formed using a tool or tool string incorporating a perforating gun loaded with shaped charges. The gun is lowered into the well, for example by means of a wireline, and the gun is activated to detonate the shaped charges to perforate the casing and to allow fluids to flow from the formation into the production well. Perforating guns are only one example of the downhole tools that may be inserted into the well. An example of such a perforating system is described in U.S. Pat. No. 6,779,605, which is directed to a system for controlling the activation of a downhole tool.

The installation and removal of various drilling tools in a well, or borehole, involves the use of heavy drilling tool strings suspended, for example, by wirelines or by cables which must be raised and lowered during drilling operations. The weight of such equipment poses serious safety issues, for the cable holding a tool string can break or be disconnected because of defective materials, operator error, or for other reasons. Falling tool strings not only can cause serious and costly damage to drilling equipment as well as significant delays in the drilling operation, but can cause serious injury and death to oilfield workers. For this reason, tool string housings are suspended separately from the tool strings and are frequently provided with an internal "tool trap"; that is, a mechanism to catch accidentally released tool strings to prevent them from falling.

Such internal tool traps suffer from two significant drawbacks: (1) they do not cushion the impact of a falling tool string on the trap mechanism, potentially damaging the tool, and (2) they are ineffective when the tool string is lowered below the position of the trap in the housing, as happens during inspection of the tool string. It is therefore desirable that a tool trap be designed to address these issues.

A typical contemporary drill string assembly is illustrated in U.S. Pat. No. 8,534,382 to VanPelt et al, which provides nomenclature for and illustrates the components needed to support and rotate a drill string during drilling. A number of other patents describe tools, stabilizers and control systems for protecting drill strings, including U.S. Pat. No. 3,949,150 to Mason et al, U.S. Pat. No. 6,408,948 to Fontana et al and U.S. Pat. No. 7,392,861 to Fouillou et al, all of which are incorporated herein by reference for understanding the state of the art and the relevant nomenclature.

None of the above cited references or patents, alone or in combination, address the safety issues encountered by oil field workers, particularly when a tool or a tool string is being raised and lowered by a conventional wireline, as happens during installation or inspection of the tool string.

Thus, there is an unmet need for an apparatus and a method for safely controlling drill string components during drilling operations so that when a downhole tool or tool string which is supported on a drill string, on a wireline, or on some other support mechanism is raised or withdrawn from the well, the tool supported on the distal end of the support mechanism will be prevented from falling uncontrollably if an inadvertent loss of control of the support mechanism occurs. More particularly, there is a need for a tool trap that meets the needs for safety outlined above.

SUMMARY OF THE INVENTION

Accordingly, it is an object of the present invention to overcome the above mentioned difficulties by providing an apparatus and a method for safely controlling drill string components during drilling operations so that when a tool is being inserted into a borehole, or is being raised or withdrawn from it, the distal end of the drill string or any downhole tool will be caught or trapped in a funnel receptacle and be kept from falling uncontrollably if an inadvertent loss of control of the drill string occurs.

Another object of the invention is to provide an external tool trap that will catch unintentionally released tools in a cushioned manner that dissipates the kinetic energy of the falling equipment in such a way that any damage to tools, or the tool trap itself, as well as nearby people and equipment, is minimized.

Briefly, the apparatus and method of the present invention provide a tool trap which can be attached to the outside of a lubricator or other tool or tool string housing so that the end of tool string can be lowered past the housing for inspection with the tool trap in place to prevent damage that can be caused by an unintended release of the tool or the drill string. This external drill string trap assembly comprises a collar clamp having laterally spaced first and second vertical rails depending therefrom, the collar clamp being securable to the tool string housing. First and second energy absorbing crush cylinders are affixed to corresponding bottom ends of the first and second vertical rails, and an openable and closable catcher plate assembly is pivotally mounted on the rails in alignment with the housing. A tool-end receiving funnel receptacle is positioned on the catcher plate assembly, and is movable into coaxial alignment with the drill string housing when the catcher plate assembly is closed to receive any falling equipment and to transfer the kinetic energy of the equipment to the crush cylinders. The assembly further includes a guide plate mounted on the rails below and coaxially aligned with the drill string housing, and a debris shield surrounds the funnel receptacle when the catcher plate assembly is closed.

In greater detail, a tool trap assembly that is configured to arrest a falling drilling tool string includes a top attachment ring which fastens the device to the lower end of a lubricator or other tool string housing. At its bottom, the tool trap assembly incorporates a stopping, or fall arresting, cup-shaped funnel member which is attached to and supported by the top attachment ring by way of a pair of vertically extending connecting rods. The lower portions of the connecting rods extend beyond the tool string housing to enable the stopping member to be positioned below the housing. The stopping member includes pivotable plates which can be closed into a blocking position below the housing to prevent a tool or drill string segment from falling past the stopping cup-shaped funnel member, and which can be opened to permit the tool or drill string segment to pass freely through the tool trap.

A corresponding one of a pair of crush cylinders is disposed between the closeable stopping means and the lower end of each connecting rod, in such a way that the kinetic force generated by the impact of a tool string or a drill string segment falling on the closeable stopping member will be absorbed by the crush cylinders. The tool trap assembly can thus be fastened to the lower end of a lubricator or other tool or drill string housing so as prevent injury or damage from unintended or accidental tool or drill string releases, while still permitting the end of the tool string to be lowered past the housing for inspection or installation externally of the housing.

The invention is further directed to a method for catching the end of a tool string located in a housing for a drilling rig in the event of an inadvertent loss of control of the string, for example when inspecting or servicing the tool. The tool string may be positioned for axial vertical motion through a vertical housing such as a lubricator, and the method includes locating an openable and closable catcher plate assembly below the housing, opening the catcher plate assembly to permit insertion of the tool string into a well through the housing, or closing the catcher plate assembly to prevent the tool string from passing through and out of the housing. The method includes dissipating kinetic energy produced by loss of control of the tool string when the string strikes a closed catcher plate assembly, with the energy being absorbed by mounting a crushable energy absorbing material to the catcher plate assembly.

BRIEF DESCRIPTION OF THE DRAWINGS

The above and still further objects, features and advantages of the present invention will become apparent upon consideration of the following detailed description of preferred embodiments thereof, particularly when taken in conjunction with the accompanying drawings, wherein like reference numerals in the various figures are utilized to designate like components, in which.

DETAILED DESCRIPTION OF PREFERRED EMBODIMENTS

Figure 1A:
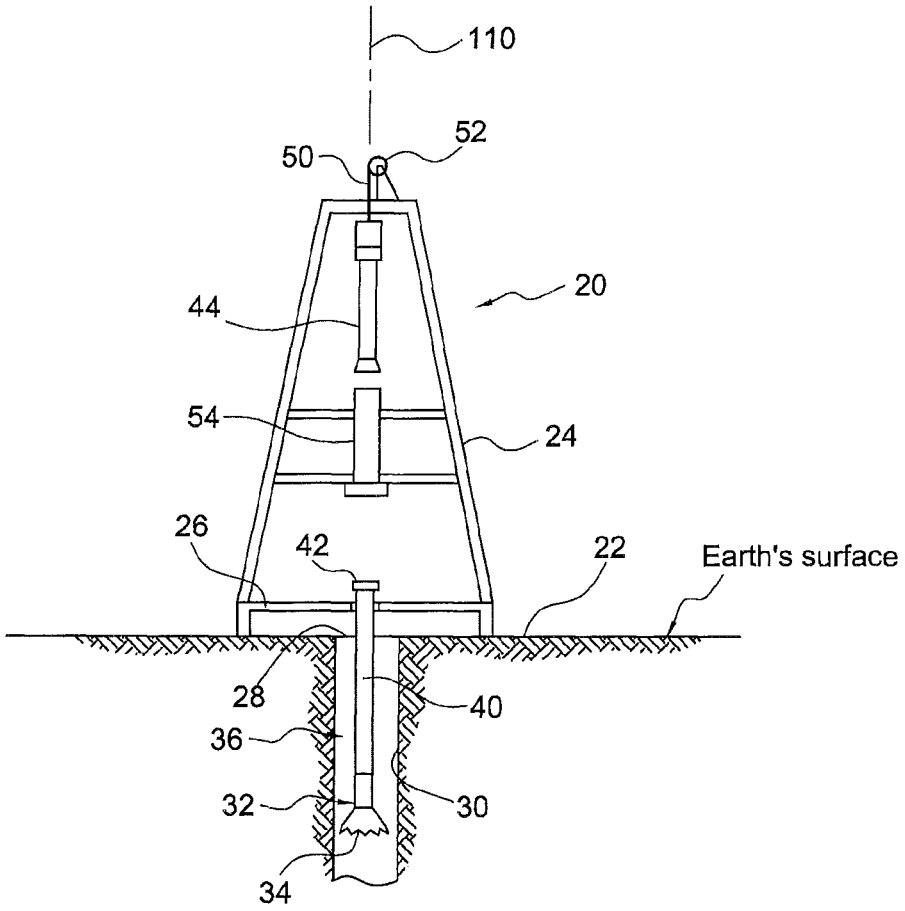
FIG. 1A PRIOR ART
FIG. 1A diagrammatically illustrates a prior art drilling rig having a drill string support structure in accordance with the prior art.
Figure 1B:
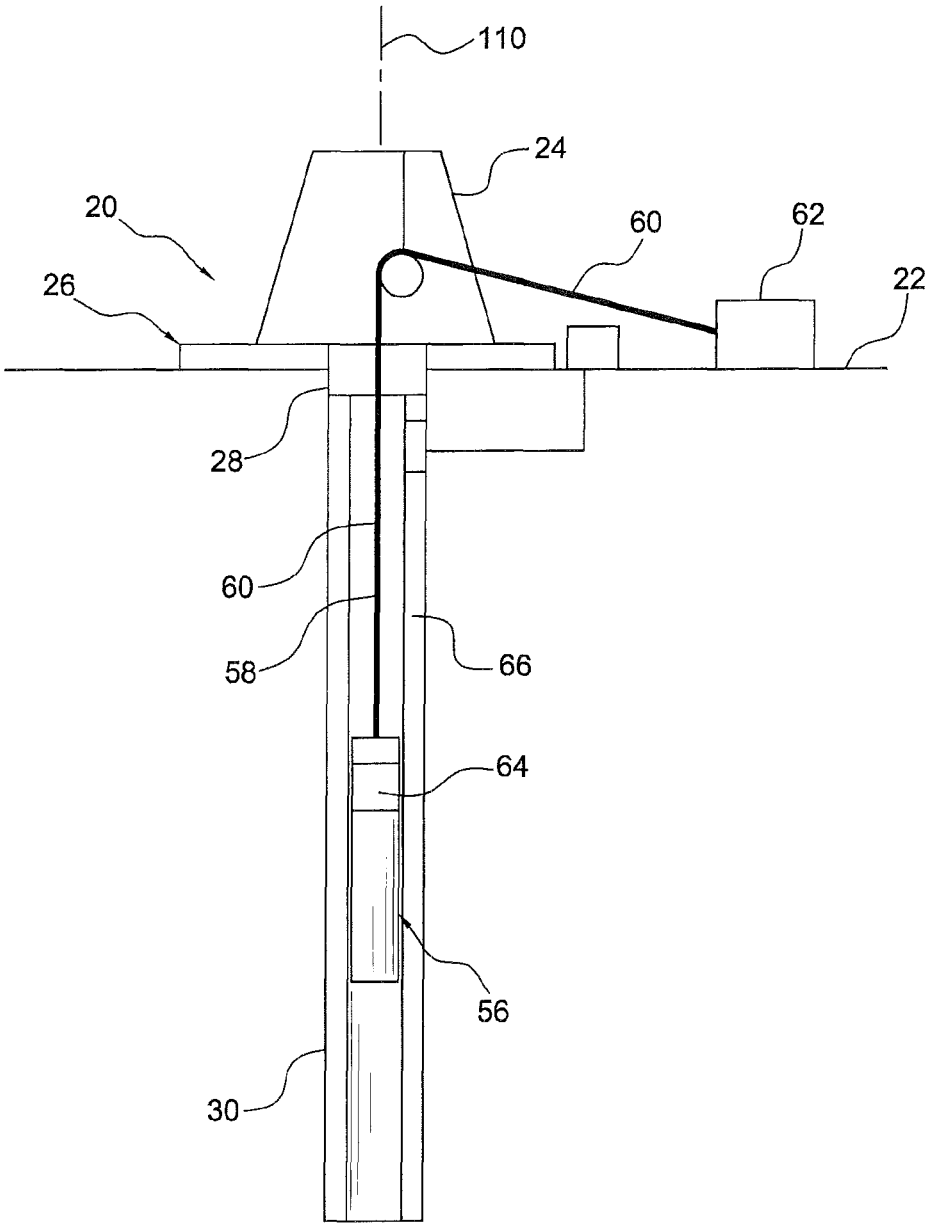
FIG. 1B PRIOR ART
FIG. 1B is a diagrammatic illustration of a prior art drilling rig having a wireline-supported downhole tool, which may be a casing perforating tool or tool string.

As illustrated at 20 in FIGS. 1A and 1B, it is known in the prior art to provide at a well drilling site 22 a drilling support structure which may be diagrammatically illustrated by a derrick 24 having a platform 26 at a wellhead 28 for the borehole 30 being drilled. As is conventional, during a drilling operation a drilling tool 32 having a drill head and bit 34 is supported in the borehole by a drill string 36 made up of hollow steel pipe segments 40 connected end to end by suitable threaded fittings, as illustrated diagrammatically by threads 42 at the upper end of segment 40. Suitable drive motors either at the surface or at the drill head, and controls (not shown) which may be mounted on platform 26, drive the drill bit, for example by rotating the drill string 36 from the surface or by rotating the bit by a hydraulic motor in the drill head, to advance the drilling tool assembly down the borehole. Directional control of the drilling is obtained in known manner, as by the use of a bent sub at the lower end of the drill string.

Periodically, additional segments 44 are threaded onto the near end of the drill string 36 to allow the drill head to reach desired depths in the earth. The additional segments 44 are supported on the derrick, moved into place over the existing string in the well, and are lowered, as by a crane or by a suitable cable or chain 50 and a winch 52 through a guide housing 54 that is secured to the derrick and aligned vertically with the well head.

FIG. 1B illustrates a prior art well drilling site 22 wherein the drill string 36 has been lifted out of the well to allow insertion of a downhole tool or tool string 56 carried by a suitable support mechanism such as a drill pipe, coiled tubing, slick line, cable, wireline or the like, illustrated at 58 and supported on the derrick. For convenience of reference, the component 58 will be referred to herein as a wireline. As known, a wireline may incorporate conventional telemetry lines 60 connected to a surface controller 62 and to downhole controls 64 on the tool 56. In this illustration, the well 30 is shown as incorporating a casing 66.

As is known, downhole tools are inserted into or withdrawn from wells using an overhead support such as a crane. The tool 56 may take a variety of forms, as, for example, a well casing perforator utilized in finishing a well, as discussed above, but will for convenience herein be referred to as a well tool or tool string. Such a tool may consist of, for example, several five-foot long tool sections that are lowered into a well which may be vertical or may be diagonal or even horizontal. In the latter cases, the tool will slide along the internal surface of the well casing as it is being inserted, and thus usually requires lubrication before it enters the well bore. However, even when lubricated the tool may get stuck in the well, requiring a large tensile force to remove it. This force may damage the wireline or support fittings, and this can cause failures and dropped tools at the surface, endangering workers and equipment.

Figure 2A:
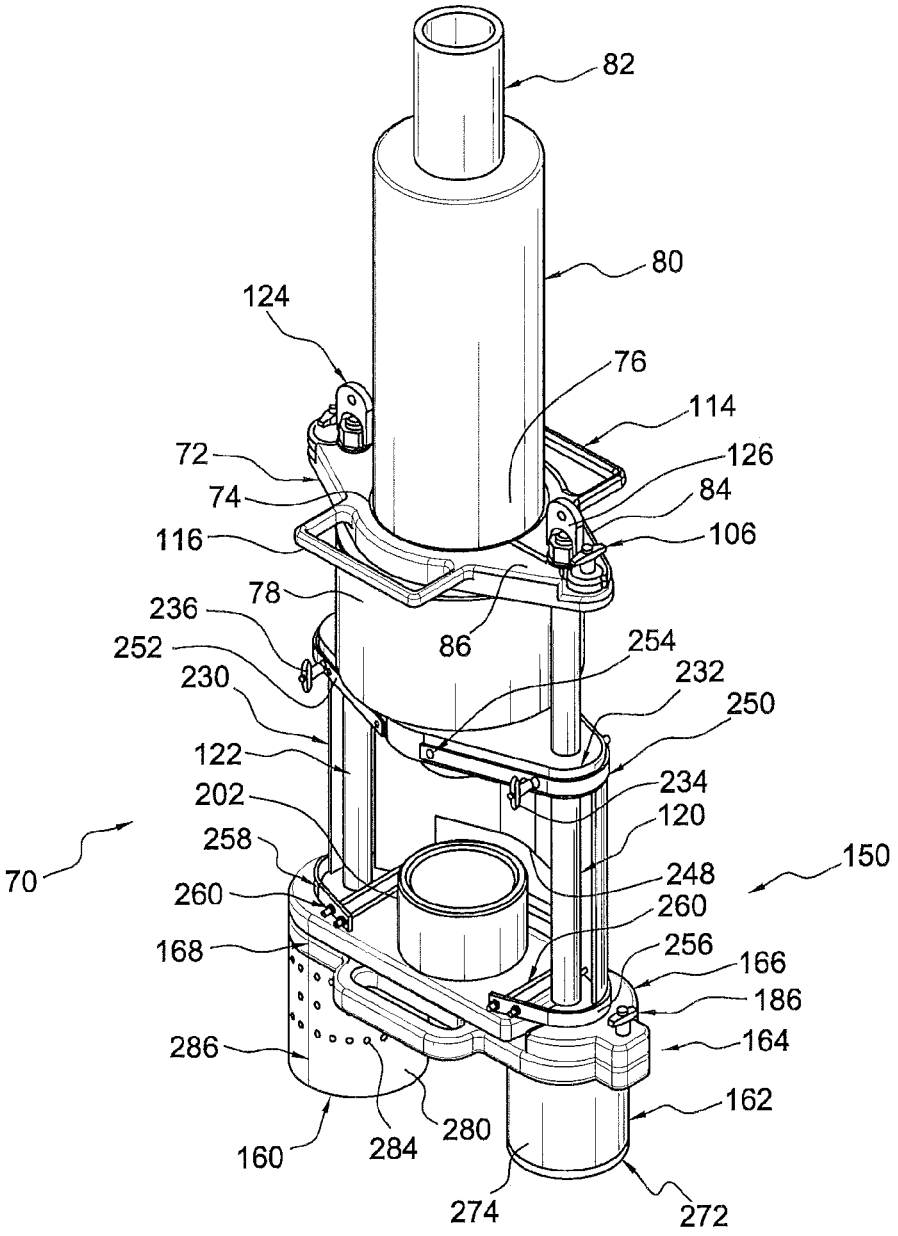
FIG. 2A illustrates a rear perspective view of a preferred embodiment of a tool catcher mounted on, and externally of, a safety housing, in accordance with the present invention.
Figure 2D:
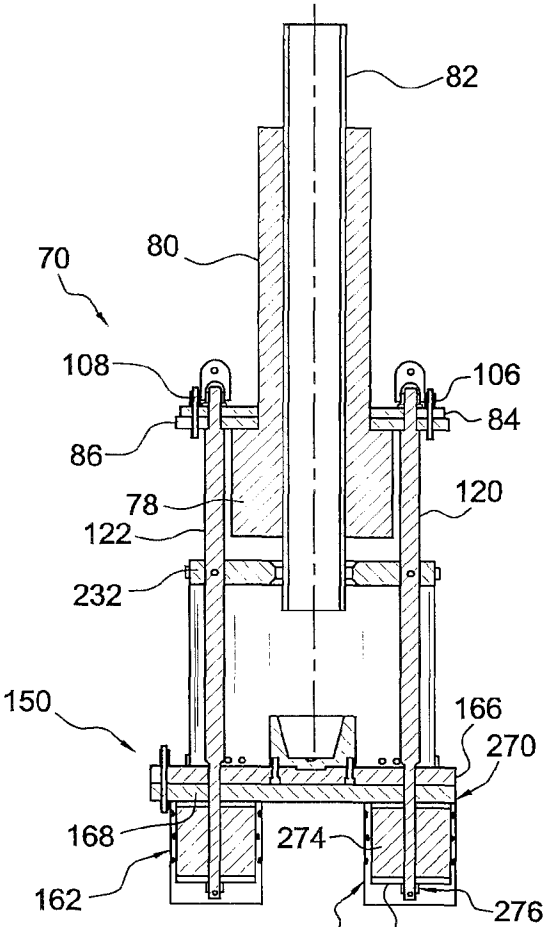
FIG. 2D is a sectional view taken along line D-D of FIG. 2C.
Figure 2C:
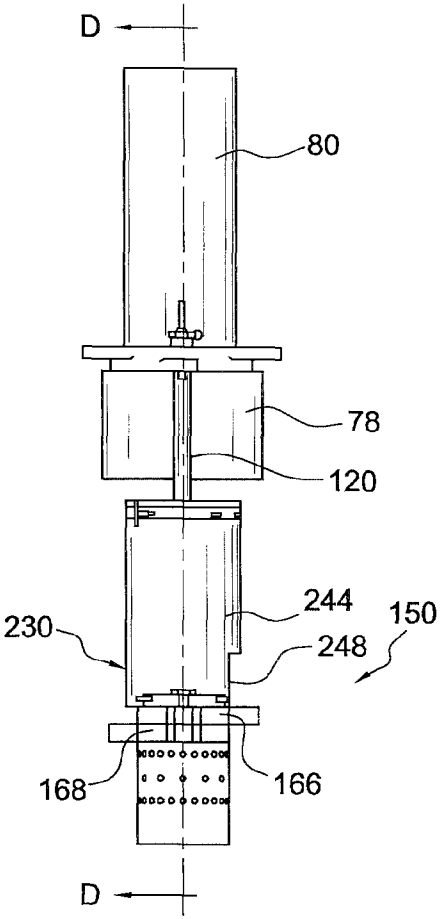
FIGS. 2B and 2C are front and side elevations of the tool catcher of FIG. 2A.
Figure 2B:
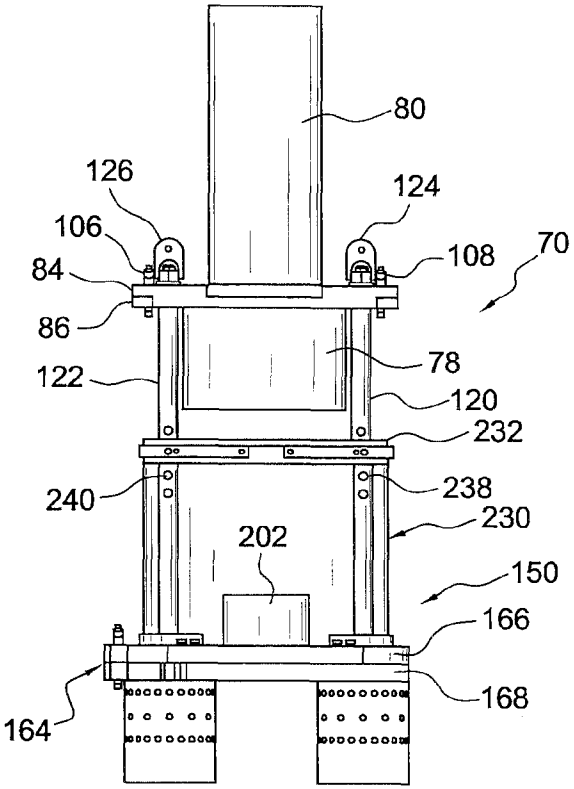
Figure 2E:
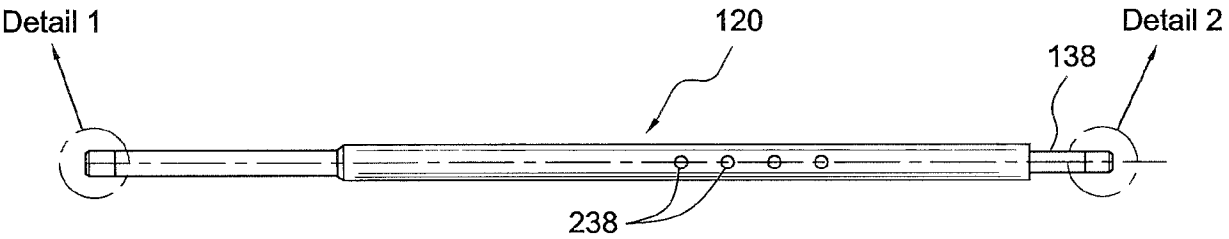
FIGS. 2E-2G are detailed views of portions of the tool catcher of FIG. 2A.
Figure 2G:
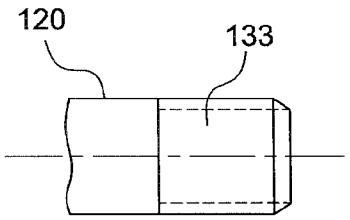
Figure 2F:
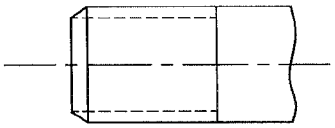
Figure 2H:
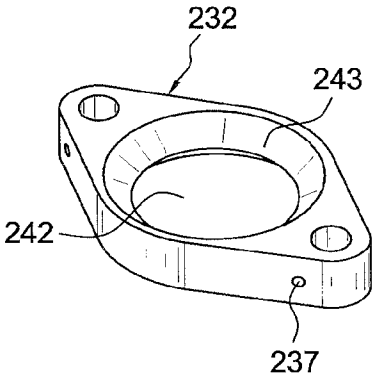
FIGS. 2H-2J are perspective, top plan and sectional views of an entry guide plate for the tool catcher of FIG. 2A.
Figure 2I:
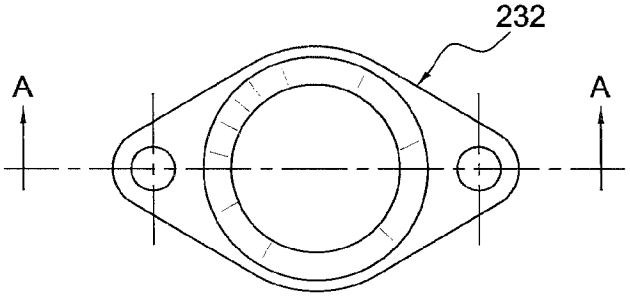
Figure 2J:
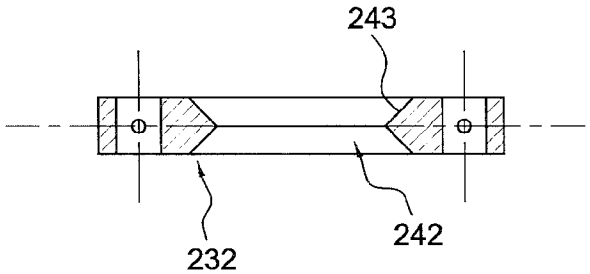
Figure 3:
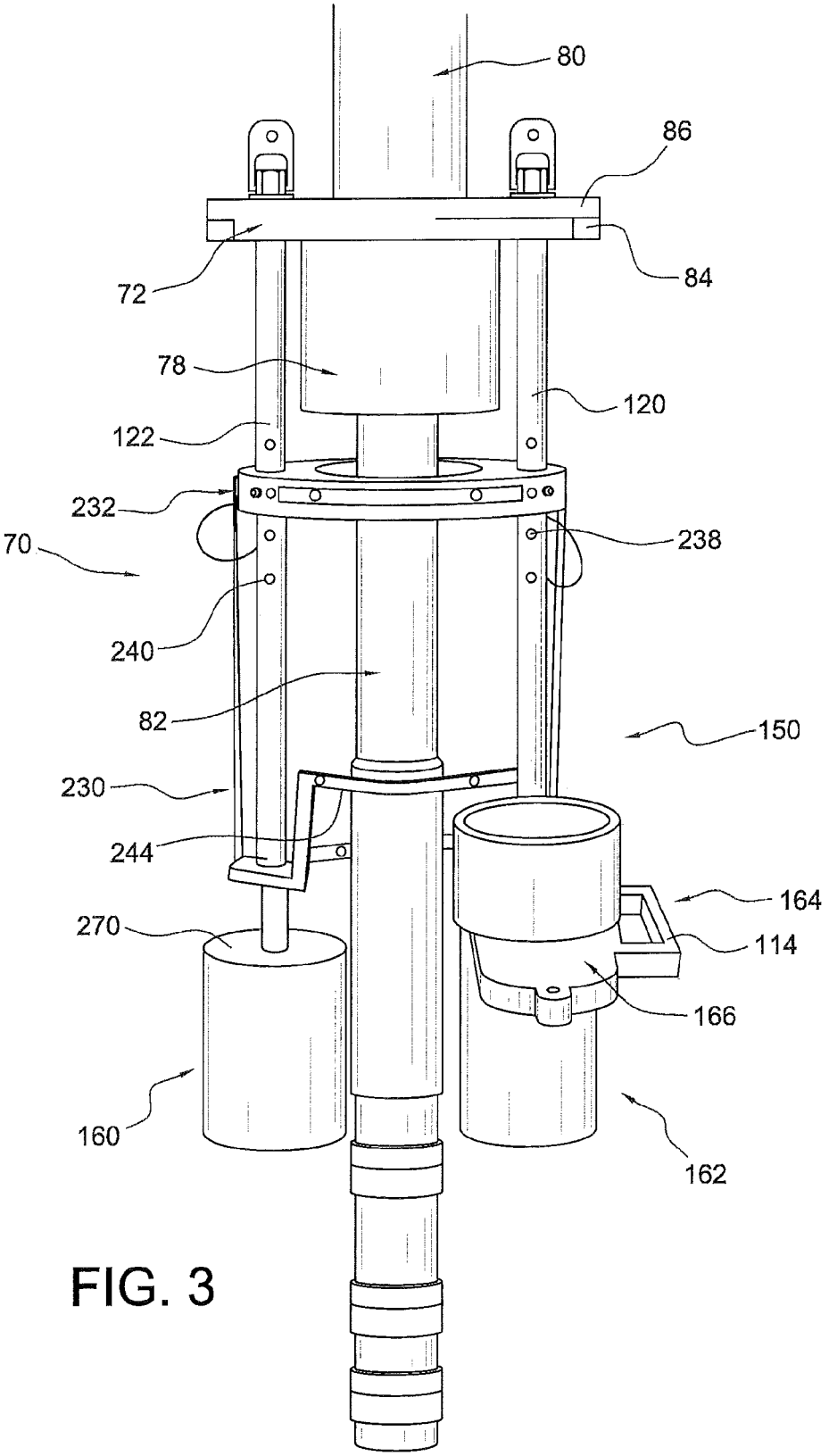
FIG. 3 illustrates a front view of the preferred embodiment of the invention illustrated in FIG. 2.
Figure 4:
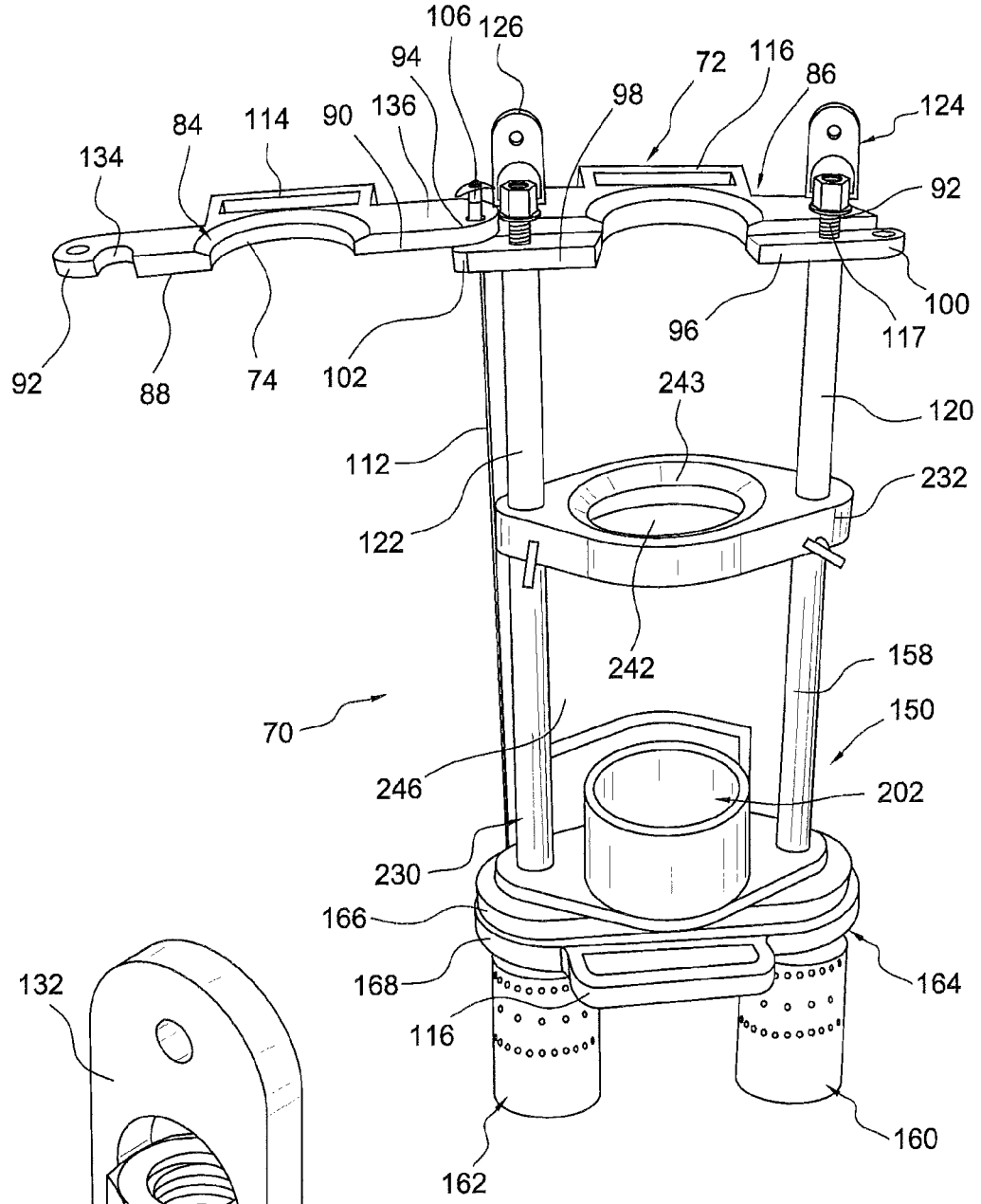
FIG. 4 illustrates a rear view of the preferred embodiment of the invention removed from the safety housing of FIG. 2.
Figure 5A:
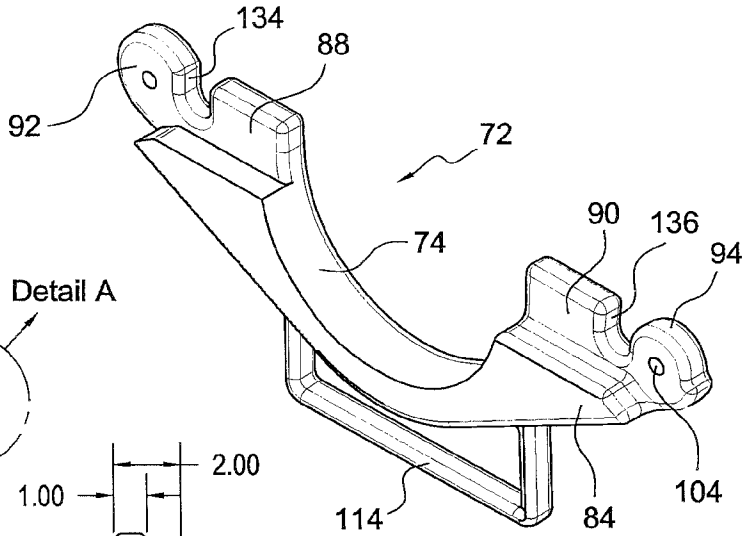
FIGS. 5A and 6A are perspective views of front and rear sections of a collar clamp portion of the tool catcher of FIGS. 2-4.
Figure 5D:
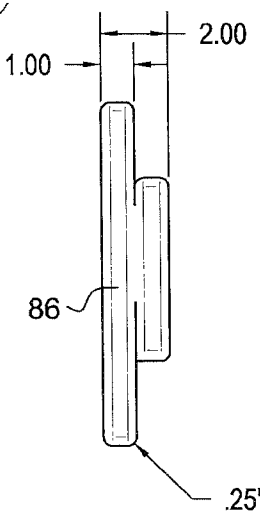
FIGS. 5B-D are top plan, detail and end views, respectively, of the collar clamp portion of FIG. 5A.
Figure 5B:
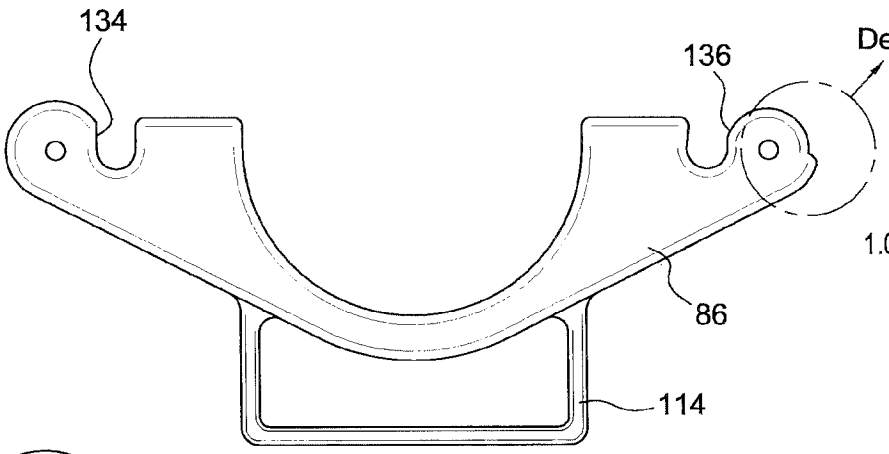
Figure 5C:
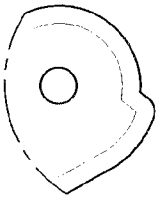
Figure 6A:
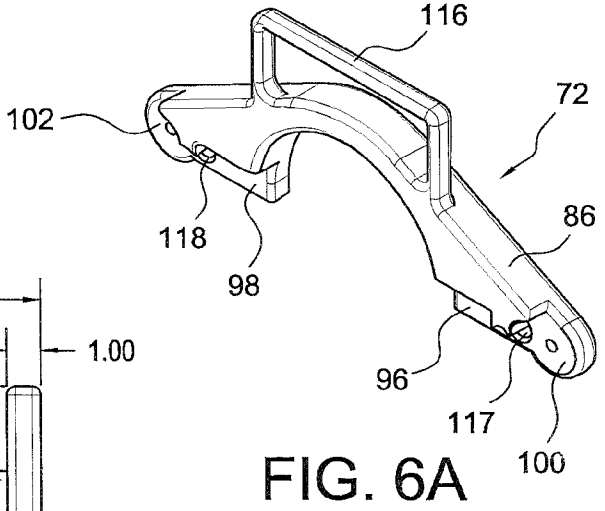
Figure 6B:
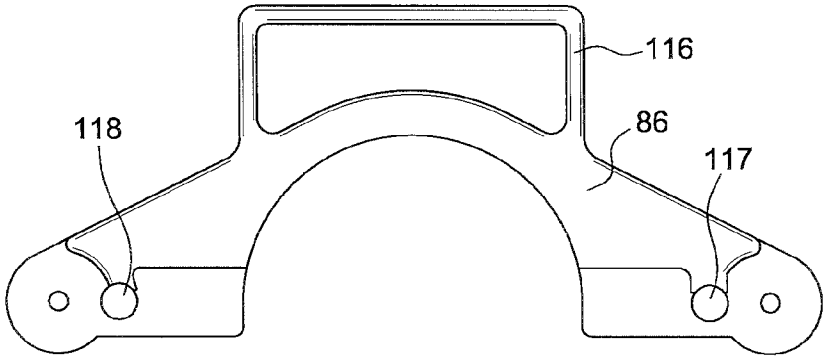
FIGS. 6B and 6C are top plan and end views of the collar clamp portion of FIG. 6A.
Figure 6C:
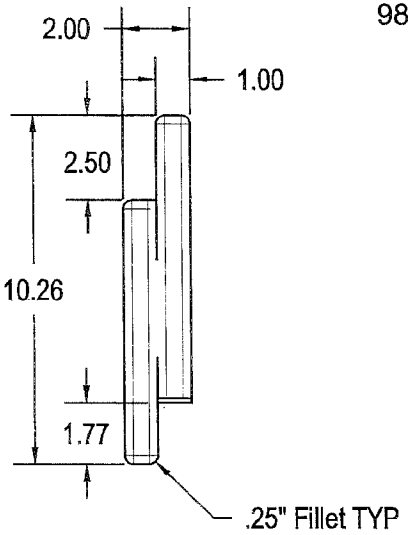

To prevent such damage, an external drill string trap assembly 70 in accordance with the present invention and best illustrated in FIGS. 2A-D, 3 and 4, is removably secured in the drilling rig, or derrick 24. Referring now to these illustrations, where FIG. 2A is a rear perspective view, FIG. 2B is a front elevation, FIG. 2C is a right side elevation, FIG. 2D is a sectional view taken along line D-D of FIG. 2C, and FIGS. 3 and 4 are perspective front and rear views, the external drill string trap assembly 70 includes an attachment ring, or upper collar clamp 72 which is configured to have a large central bore 74 sized to fit securely around a lower portion 76 and above a collar 78 of a tool string housing 80, which may be a conventional lubricator pipe for receiving a tool string or drill pipe segment 82. As depicted, and also seen in FIGS. 4-6, the attachment ring, or clamp 72 comprises first and second generally semicircular front and rear clamp sections 84 and 86 which incorporate overlapping flange portions having diametrically opposed overlapping hinge ears. The front clamp section 84 includes flanges 88 and 90 with respective ear portions 92 and 94 and the rear clamp section 86 includes flanges 96 and 98 with respective ear portions 100 and 102. Each ear incorporates a through aperture, such as aperture 104 illustrated in FIG. 5A, which is aligned with the aperture in a corresponding overlapping ear for receiving corresponding quick release locking pins 106 and 108 to lock the clamp in place around the housing 80 when the clamp is closed.

Figure 7:
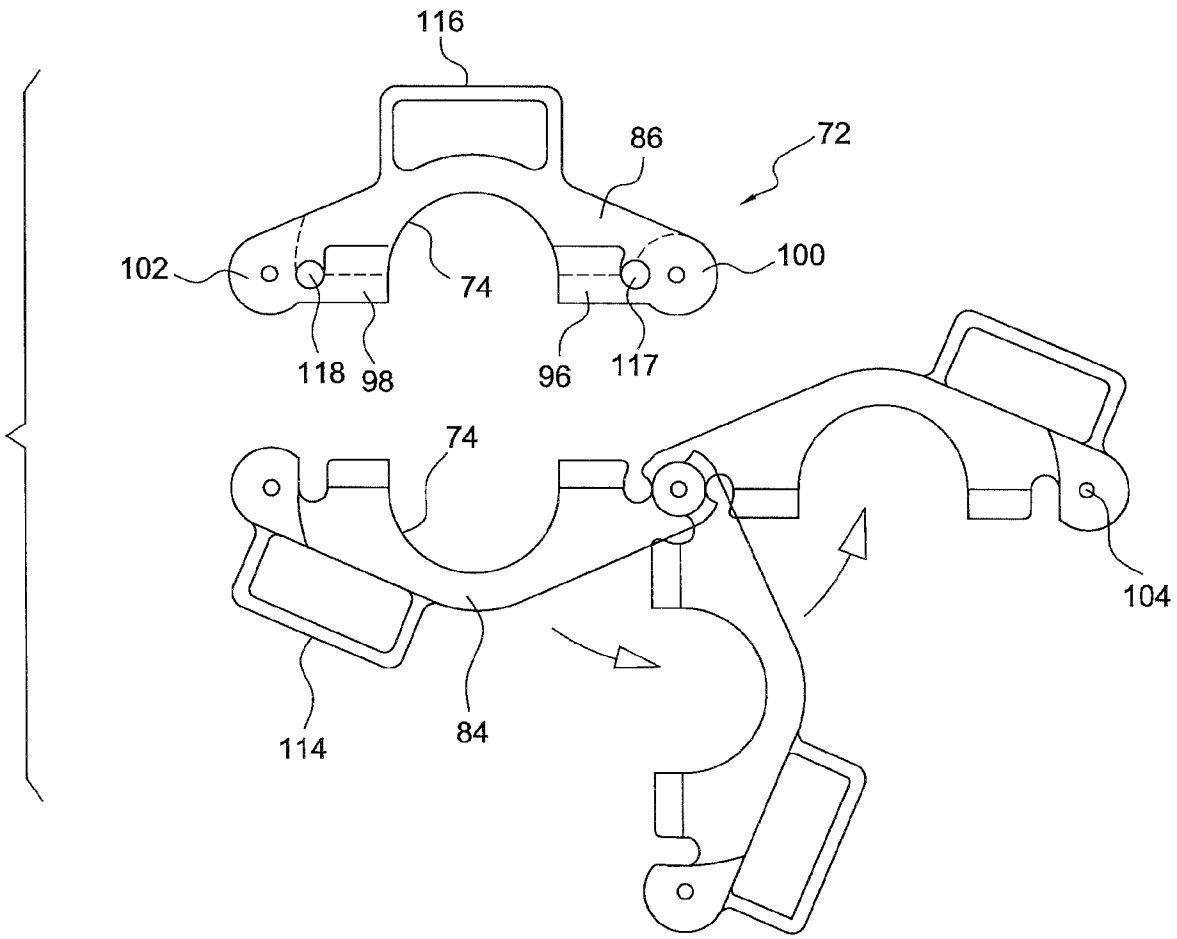
FIG. 7 is a diagrammatic bottom view of the collar clamp portion of the tool catcher of FIGS. 2-6, illustrating the pivotal motion of the collar clamp.
Figure 12:
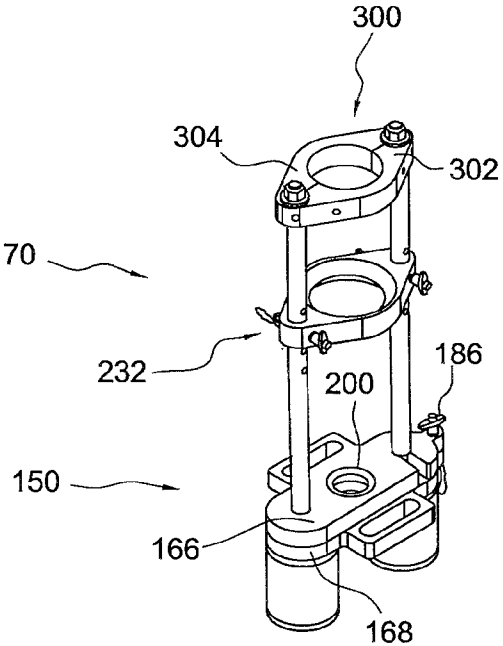
FIG. 12 is a diagrammatic perspective view of the assembly of FIGS. 9-11.
Figure 13:
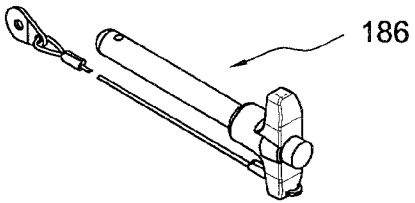
FIG. 13 is a perspective view of a securing pin for the stopping support assembly of the invention.
Figure 11:
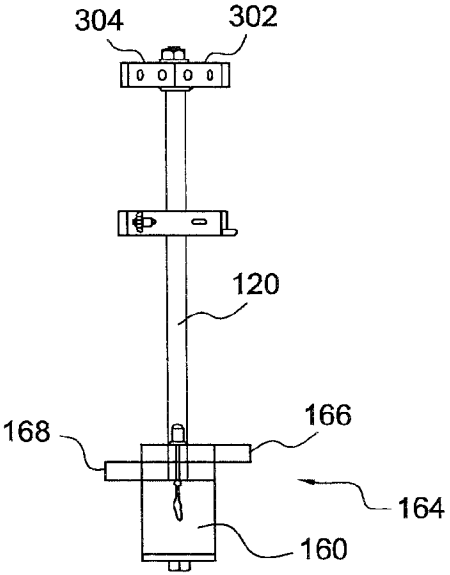
FIGS. 10 and 11 illustrate front elevation and side elevation views, respectively, of the assembly of FIG. 9.
Figure 9:
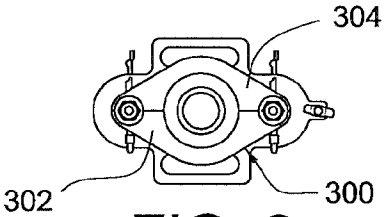
FIG. 9 is a diagrammatic top plan view of a stopping support assembly in accordance with a second embodiment of the invention.
Figure 10:
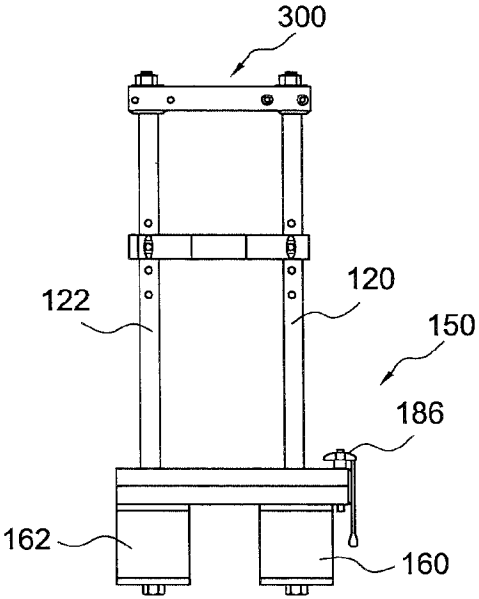

As illustrated in FIGS. 2-4, ears 94 and 102 are aligned when the clamp is closed and the flanges 90 and 96 are overlapping, so that when pin 106 is inserted through the respective apertures in these ears a hinge is formed for the clamp 72. The clamp is pivoted on pin 106 to open and then to close so central aperture 74 surrounds the lower portion 76 of the housing 80. The clamp is secured in place around the housing by inserting pin 108 through the aligned apertures in ears 92 and 100 when it is closed so that flange 88 overlaps flange 96. FIG. 7 is a diagrammatic bottom view illustration of the clamp 72, and illustrates the hinge motion of the front clamp section 86.

The housing 80 is typically aligned in a substantially vertical orientation in the drilling rig so that tool string components such as drill pipe segments 40 and 44 (FIG. 1A) or a downhole tool 56 and wireline 58 (FIG. 1B) are coaxially aligned along a substantially vertical drill or tool string axis 110. When the attachment ring or clamp 72 is installed on the housing 80, the central bore 74 of the clamp is coaxially aligned with the substantially vertical tool or drill string axis 110. The attachment ring halves 84 and 86 are releasably joined together by the pins 106 and 108, which preferably carry quick-release fasteners and may be attached to the clamp by suitable lanyards such as that illustrated at 112 in FIG. 4. As illustrated, each of the clamp portions 84 and 86 may incorporate a corresponding handle, such as respective handles 114 and 116, for ease in opening and closing the clamp.

Figure 8:
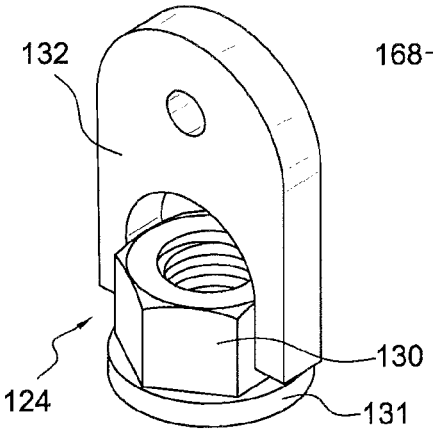
FIG. 8 is a perspective view of a lifting eye nut for the tool catcher of FIGS. 2-4.

The rear clamp portion 86 (see FIG. 6A) of the collar clamp 72 for the tool string trap assembly 70 has laterally spaced vertical bores 117 and 118 which pass through flanges 96 and 98, respectively, to receive and carry first and second depending connecting rods or rails 120 and 122 (see FIGS. 2E-2G) which extend downwardly on opposite sides of, and past the bottom end of, the housing collar 78, as illustrated in FIGS. 2A-2D, 3 and 4. Threaded fasteners, such as lifting nuts 124 and 126 (see FIG. 8) each incorporating a nut 130 and washer 131 secured, as by welding, to a lifting ring 132, are provided to secure the rods 120 and 122 to the clamp 72 by way of threads 133 on the top end of the rod. The washer 131 rests on the top surface of the rear clamp portion, while the front clamp portion 84 incorporates indentations 134 and 136 which receive the reduced-diameter upper end portions 138 (FIG. 2E) of the rods when the clamp is in the closed position. The connecting rods are arranged around the attachment ring, or collar clamp 72 to provide generally even support to the lower portions of the drill string trap assembly 70. For example, when two connecting rods are used as depicted, they should lie on opposite sides of the tool string housing.

Figure 14:
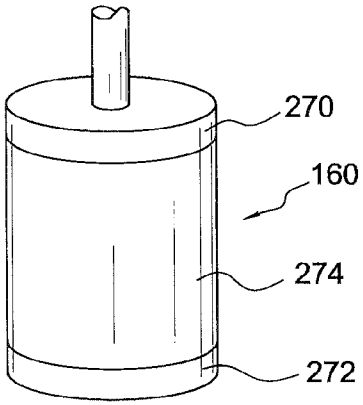
FIG. 14 is a perspective view of a crush cylinder for the stopping support assembly of the invention.
Figure 15:
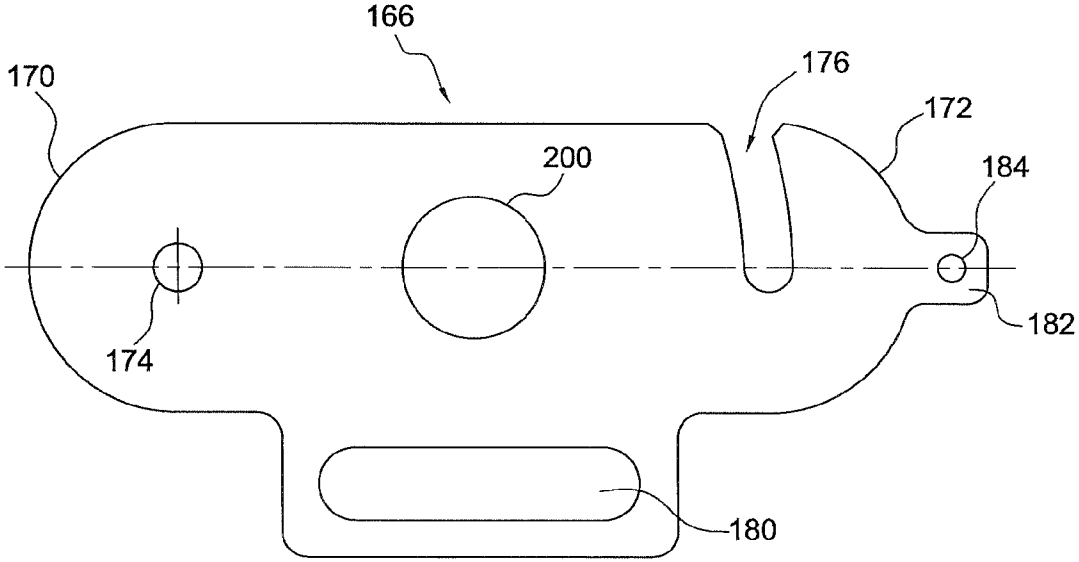
FIG. 15 is a diagrammatic bottom view of a catcher plate for the stopping support assembly of the invention.
Figure 16:
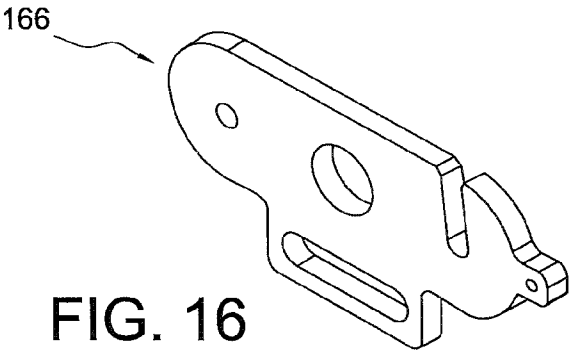
FIG. 16 is a perspective view of the catcher plate of FIG. 15.

Secured to and carried by the bottom ends of rods 120 and 122 is an openable and closeable tool stopping support assembly 150, illustrated in FIGS. 2A-2D, 3 and 4, and diagrammatically in FIGS. 9-15. This assembly includes a pair of crush cylinders 160 and 162 (FIG. 14) secured to the bottom ends of, and carried by, depending connecting rods 120 and 122, and a pivotally mounted catcher plate assembly 164 having upper and lower stopping plates 166 and 168, respectively, which are slideably and pivotally attached to the connecting rods and are supported by the respective crush cylinders. As illustrated in FIGS. 15 and 16, the upper plate 166, as viewed from the bottom, is generally rectangular with rounded ends 170 and 172 covering and generally conforming to the shapes of the crush cylinders 160 and 162, respectively. The end 170 includes an aperture 174 which receives rod 120, is pivotal around that rod, as illustrated in FIG. 3, and can slide up and down on the rod. The end 172 of the plate includes an arcuate slot 176 which receives and engages rod 122, and also allows the plate to slide up and down the rod. A handle 180 on one side of the plate 160 enables a user to move the plate from the forwardly open position illustrated in FIG. 3, to a closed position as illustrated in FIG. 4.

The lower plate 168 is similar to plate 166, and is also mounted on rod 120 for pivotal motion to engage its arcuate slot with rod 122 in its closed position. Both plates incorporate an ear 184 on one end, with the ear on plate 166 overlapping the ear on plate 168 in their closed positions, the overlapping apertures being adapted to receive a locking pin 186 (see FIGS. 9-13) to secure the plates in their closed positions. When mounted on the connecting rods, the plates may be rotated about the rods and positioned to a closed position to block the movement of a tool string through the housing 80 and past the position of the rotatable plates, or opened (FIG. 3) to allow the tool string to pass through the tool catcher plate assembly.

Figure 17:
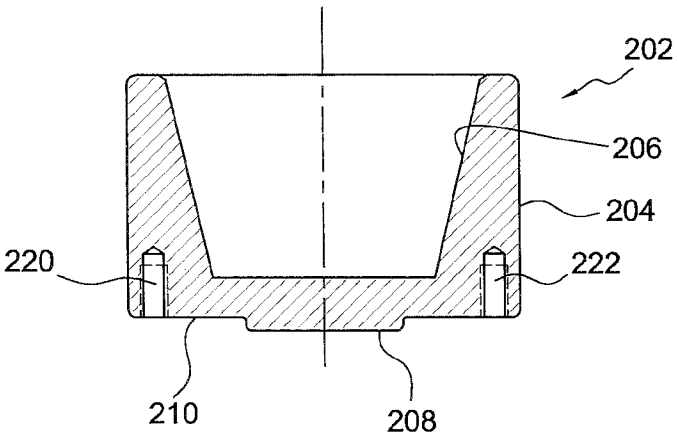
FIG. 17 is a sectional view of a catcher funnel for the catcher plate of FIG. 15.
Figure 18:
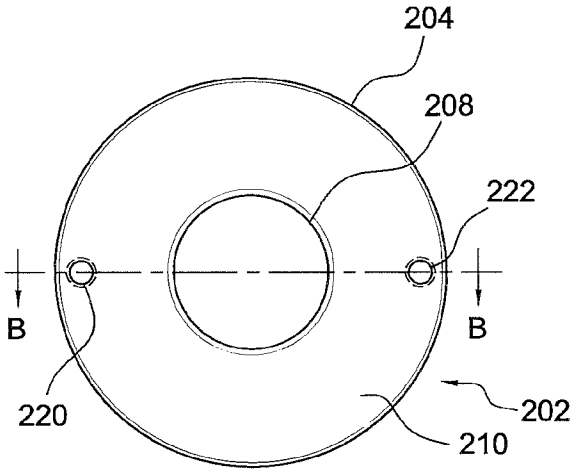
FIG. 18 is a bottom view of the catcher funnel of FIG. 17.
Figure 19:
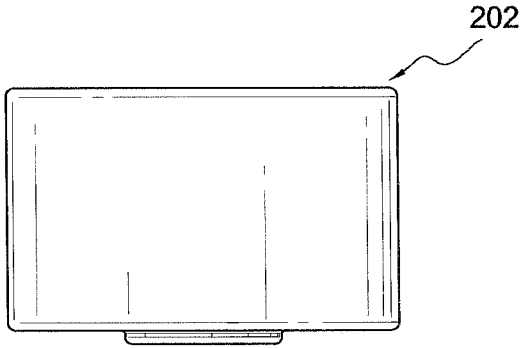
FIG. 19 is a side elevation view of the catcher funnel of FIG. 17.

The top plate 166 incorporates a central aperture 200 which is located to receive and secure a funnel cup 202 illustrated in FIGS. 2-4, and shown in greater detail in FIGS. 17-19, wherein FIG. 17 is a sectional view along line B-B of the bottom plan view of FIG. 18, and FIG. 19 is side elevation view of FIG. 18. The funnel has a cylindrical outer surface 204 and an inwardly sloping, generally conical inner surface 206. A central shoulder portion 208 is centered on its bottom exterior surface 210 to engage the aperture 200 on plate 166 to thereby center the conical surface 206 in the path of a tool string located in housing 80 when the stopping plates are closed. The funnel may be secured to the top plate 166 by screws or bolts engaging apertures 220 and 222 in the bottom of the funnel. The conical inner surface of the funnel directs the impact of a falling tool or tool string to the center of the catcher plate assembly 150 to distribute the force of the impact on the crush cylinders 160 and 162.

Mounted on the connecting rods, or rails, 120 and 122, above the catcher plate assembly 164 and forming part of the stopping support assembly 150, is a debris shield 230 (FIGS. 2A and 20-27), the bottom edge of which rests on the top of plate 166 and the top edge of which is secured to an entry guide ring or guide plate 232 (FIGS. 2A-J, 3 and 4). The guide ring may be a single plate, and is slideably mounted on the middle portion of the connecting rods 120 and 122 below the end of the tool string housing 80. The guide ring incorporates a pair of connector pins 234 and 236 which extend through apertures 237 in the edge of the ring to engage selected ones of a row of receptacles 238 and 240 aligned along the rods 120 and 122 (see FIG. 2E) to vertically position the guide ring on the rods. The guide ring includes a central hole 242 (FIG. 4) aligned with the tool string housing 80 and slightly larger than a tool string so that the tool string may pass freely through the guide ring. The edges 243 of this hole in the guide ring are beveled to help align the tool string with the guide ring and the tool string housing as the tool passes through them to the catcher plate assembly.

Figure 20:
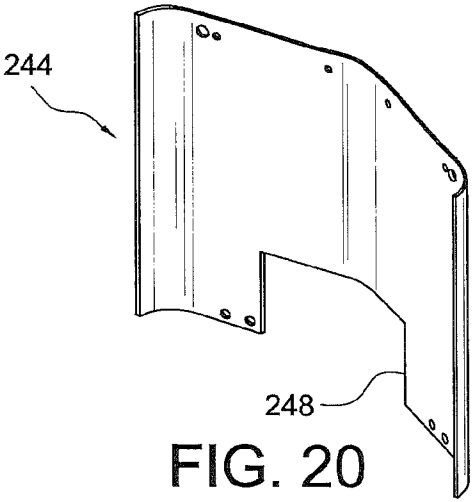
FIGS. 20-23 are perspective, front, rear, top and detail views, respectively, of a front debris shield for the stopping support assembly of the invention.
Figure 23:
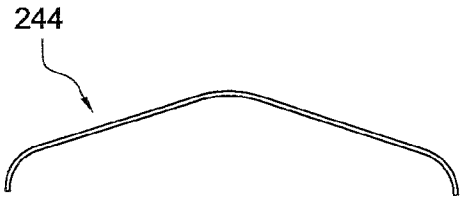
Figure 21:
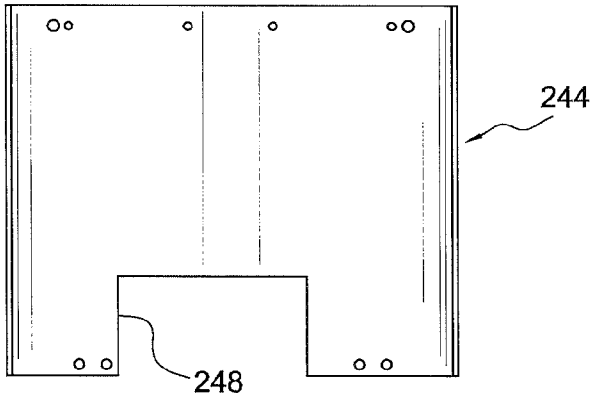
Figure 22:
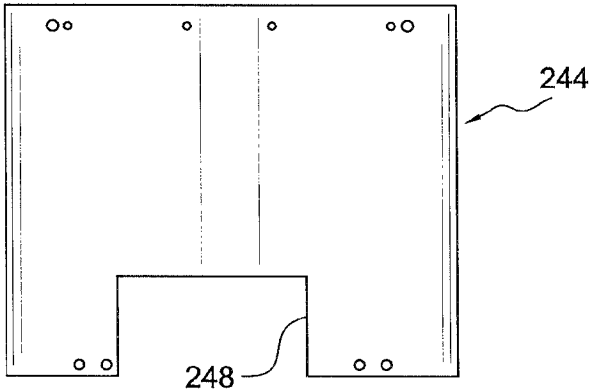
Figure 24:
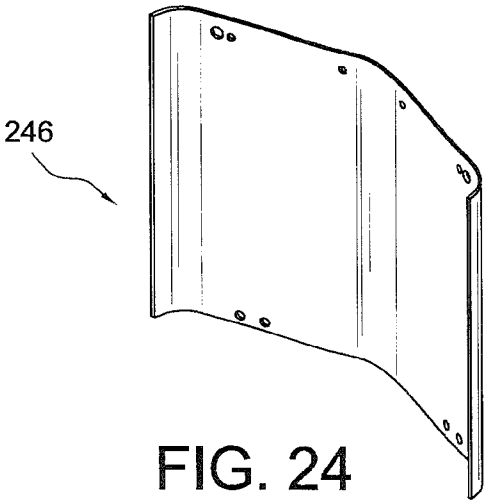
FIGS. 24-27 are perspective, front, rear, top and detail views, respectively, of a rear debris shield for the stopping support assembly of the invention.
Figure 27:
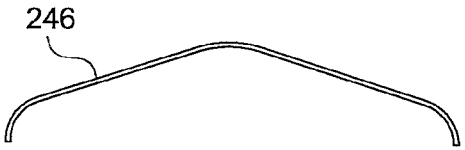
Figure 25:
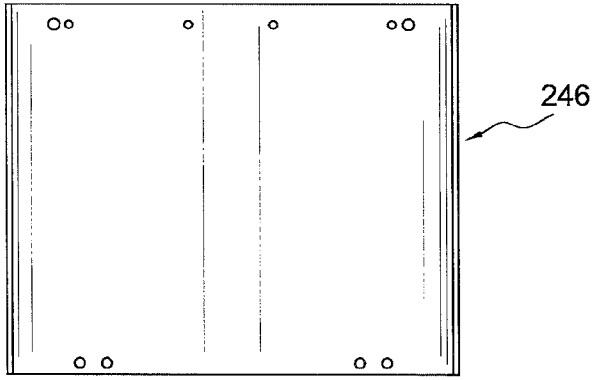
Figure 26:
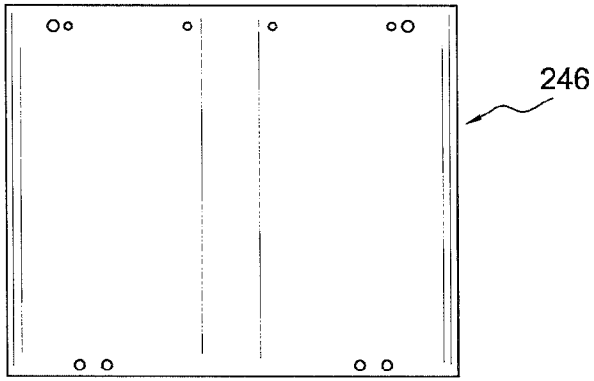
Figure 28:
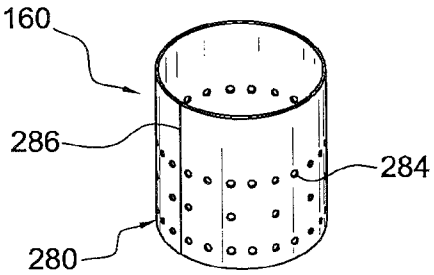
FIGS. 28 and 29 are perspective and side elevation views of a crush cylinder shield for the invention.
Figure 30:
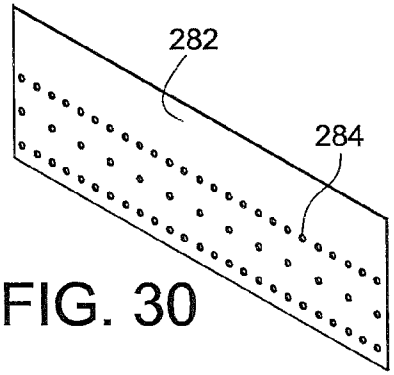
FIGS. 30 and 31 are perspective and plan views of a sheet material for fabricating the shield of FIG. 28.
Figure 31:
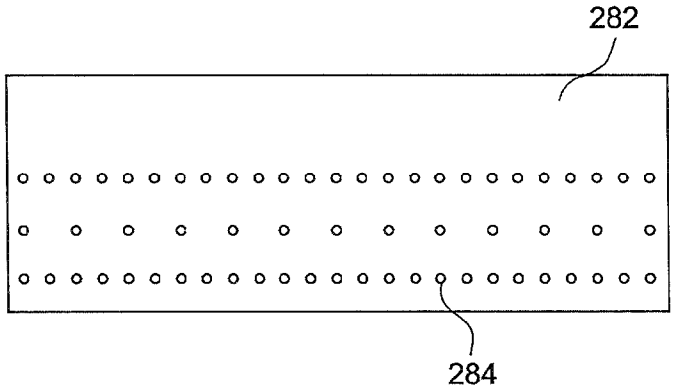
Figure 29:
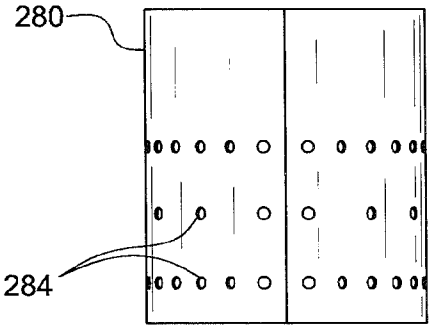

The debris shield 230 is fabricated from a transparent, strong material such as a $3/16^{th}$ inch thick sheet of Lexan, shaped to form a front panel 244 and a rear panel 246, the panels being curved as illustrated in FIGS. 20 and 24 to surround the funnel 202 and substantially cover the top plate 166 of the catcher plate assembly 164 to prevent pieces that might break from a falling tool when it strikes the catch plate assembly from scattering and injuring anyone nearby. The front panel 244 includes a cutout portion, or doorway, 248 to allow the catcher plate assembly and its mounted funnel to swing between its open and closed positions, as described above. The front and rear debris panels 244 and 246 are fastened to the guide ring by top curved U-braces 250 and 252, which may be fabricated from $3/16^{th}$ inch thick steel, using suitable fasteners such as screws 254, and are secured together at the bottom by curved U-braces 256 and 258 also fabricated from $3/16^{th}$ inch thick steel, by through bolts 260.

As best illustrated in FIG. 2D and in FIG. 14, the rods 120 and 122 extend through the catch plate assembly 164 and through the crush cylinders 160 and 162. Each crush cylinder consists of top and bottom crush washers 270 and 272 engaging the top and bottom walls of a cylindrical sacrificial energy absorbing cartridge 274, and is secured on its corresponding rod by a nut 276. The cartridge 274 may be a crushable material such as "FoamGlas" HLB insulation, available from Pittsburgh Corning, or other suitable material that is rigid enough to support the assembly 150 on the rods under normal conditions, but which is destroyed by the impact of a falling tool which strikes the funnel 202 with sufficient force to cause the catch plates to slide down on the rods so that the cartridges 274 absorb the kinetic energy of the tool.

Figure 32:
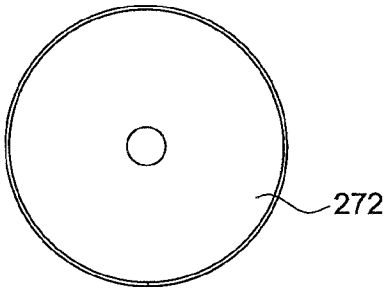
FIG. 32 is a plan view of a crush washer for the crush cylinder of FIG. 14.
Figure 33:
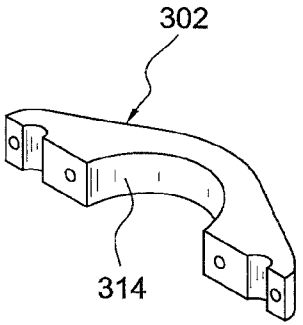
FIGS. 33-36 are perspective, sectional, front elevation, and end views, respectively, of a support collar segment for the second embodiment of the invention illustrated in FIGS. 9-12.
Figure 36:
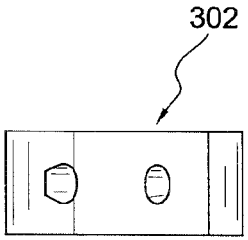
Figure 34:
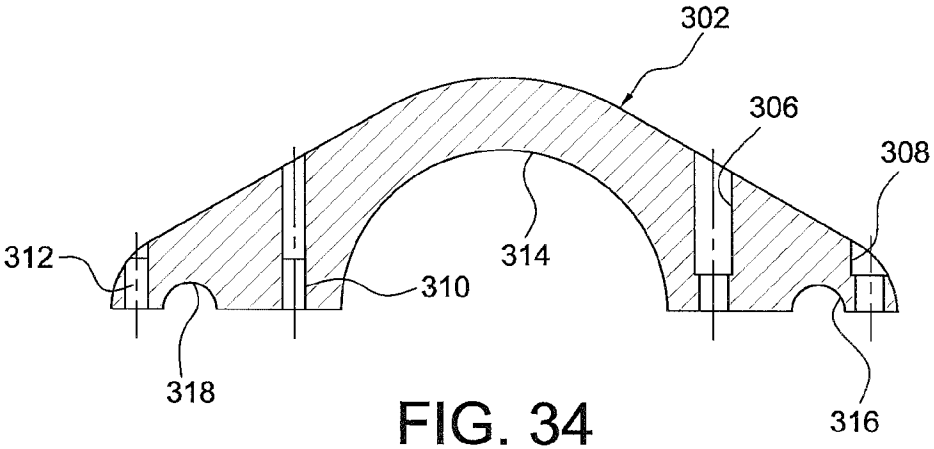
Figure 35:
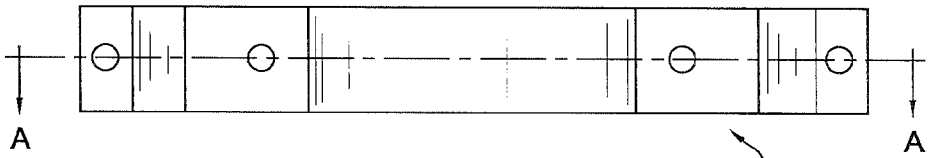

Surrounding the crushable cartridge 274 on each of the cylinders 160 and 162 is a cylindrical containment shield 280 formed from a sheet 282 of a material that is sufficiently strong to prevent debris from the cartridges 274 from scattering when they are crushed. The shield may be, for example, a 16 gauge sheet of stainless steel with spaced rows of perforations 284 to provide pressure release during a crushing operation, the opposite ends of the sheet being welded end-to-end along weld line 286 to form a cylinder. Preferably, the shield is secured to the top crush washer 270 and abuts the under surface of the plate 168 (FIG. 2D), and surrounds and slides over the lower washer 272 (FIGS. 2D and 32). It will be noted in the illustration of FIG. 2A, that the crush cylinder 160 has the containment shield 280 in place and removed from cylinder 162.

Referring again to FIGS. 9-12, the drill string trap assembly 70 here illustrated incorporates the openable and closeable tool stopping support assembly 150 described in detail hereinabove, but in this illustration has a different collar clamp. Instead of the pinned-together pivoting plates 84 and 86, which enable easy assembly and removal of the drill string trap as illustrated in FIGS. 2-4, this embodiment incorporates a collar clamp 300 having a pair of half-segments 302 and 304, one of which is illustrated at 302 in FIGS. 33-36, which are securely fastened about the housing 80 above the collar 78 to permanently mount the assembly 70 on the housing. Each segment includes a pair of through bores 306 and 308 on one end and a pair of threaded apertures 310 and 312 on the other end so that when the two segments face each other and the ends abut, bolts passing through the bores engage opposed threaded apertures to draw them together. The segments are generally C-shaped to define a central cavity 314 that surrounds housing 80 and is aligned with a drill string in housing 80, and include indentations 316 and 318 on each segment which surround and support the rods 120 and 122 when the segments are joined face to face.

The illustrated components comprising the tool catcher of the present invention (e.g., 70), with the exception of the crush cylinders, should be constructed of steel, or a similar strong and durable material and should be able to be disassembled for inspection and maintenance, including replacement of the crush cylinders, after a tool string impact. The parts of the invention should have thicknesses and dimensions suitable to absorb multiple tool string impacts without failure. The dimensions, number, and configuration of the various components of the invention may be altered as appropriate to fit the size and weight of the drilling apparatus. Such adjustments may be made without departing from the scope of the invention.

The following procedure has been found to be most effective for the use of the preferred embodiment tool catcher trap apparatus 70 of the present invention: while a tool string 82 is retracted into or above the tool string housing 80, the tool catcher of the present invention 70 is lifted to the tool string housing 80 and the attachment ring is placed over the lower end of the tool string housing and secured there. The operator should then verify that the tool catcher is securely attached to the tool string housing and properly aligned with the travel of the tool string. The rotatable catcher plates 166, 168 should be placed in the "closed" position and pinned in place to thereby prevent the tool string 82 from falling past the tool catcher unintentionally. The tool string 82 may then be lowered for inspection or use, with the rotatable catcher plates 166, 168 being moved to the "open" position (e.g., as illustrated in FIG. 3) whenever the tool string must be lowered beyond them, and returned to the "closed" position (e.g., as illustrated in FIGS. 2A and 4) for safety whenever the tool string is raised above them. It may be necessary for the operator to adjust the position of the tool string 82 as it is raised and lowered.

It will be appreciated by persons of skill in the art that the present invention provides a method for catching the end of tool string 82 in the event of an inadvertent loss of control, where the method includes the following method steps: positioning the tool string 82 for axial vertical motion through a vertical lubricator or housing 80; locating openable and closable catcher plate assembly 164 below housing 80; opening catcher plate assembly 164 to permit insertion of tool string 82 into a well 28 through housing 80; and closing catcher plate assembly 164 to prevent tool string 82 from passing through and out of housing 80. In the illustrated embodiment, when tool string slips or falls unintentionally, the fall is arrested and the kinetic energy of the falling tool string is absorbed by dissipating that kinetic energy (produced by loss of control of the tool string) when the tool string's lower or distal end strikes the closed catcher plate assembly 164. Preferably, the step of dissipating that kinetic energy includes directing the energy of the falling tool string through the catcher plate assembly 164 and into a crushable energy absorbing material (e.g., as carried within crush cylinders 160, 162).

Variations and modifications, including those described below, may be made without departing from the scope of the invention. Naturally, the sizes and dimensions may be varied from those depicted. A possible modification would be to add one or more attachment points for winches or other lifting means so that the tool catcher (e.g., 70), which may be heavy, may be lifted and positioned with mechanical assistance. These attachment points may be on the attachment ring, the connecting rods, or the guide ring. Another possible modification would be to vary the attachment means for the attachment ring. In particular, any method which allows the attachment ring to be quickly and easily attached and removed, while still providing a secure attachment, would be desirable in cases where the invention would need to be installed and removed quickly and/or frequently. Another possible modification would be to place padded and/or low-friction material on the guide ring to reduce the potential for damage to the tool string as it passes through the guide ring. Another possible modification would be to place padded material on the upper surface of the upper rotatable plate to reduce the potential for damage to the tool string if it contacts the rotatable plate.

In another embodiment of the invention, the crush cylinders 160, 162 in the exemplary embodiment may be replaced by a solid material, such as solid aluminum cylinders, to enable the device to carry a very large dead weight. In this case the tool catcher may be used with the tool string resting on the catch plates and funnel to serve as a safe support for the tool and related equipment.

Figure 37:
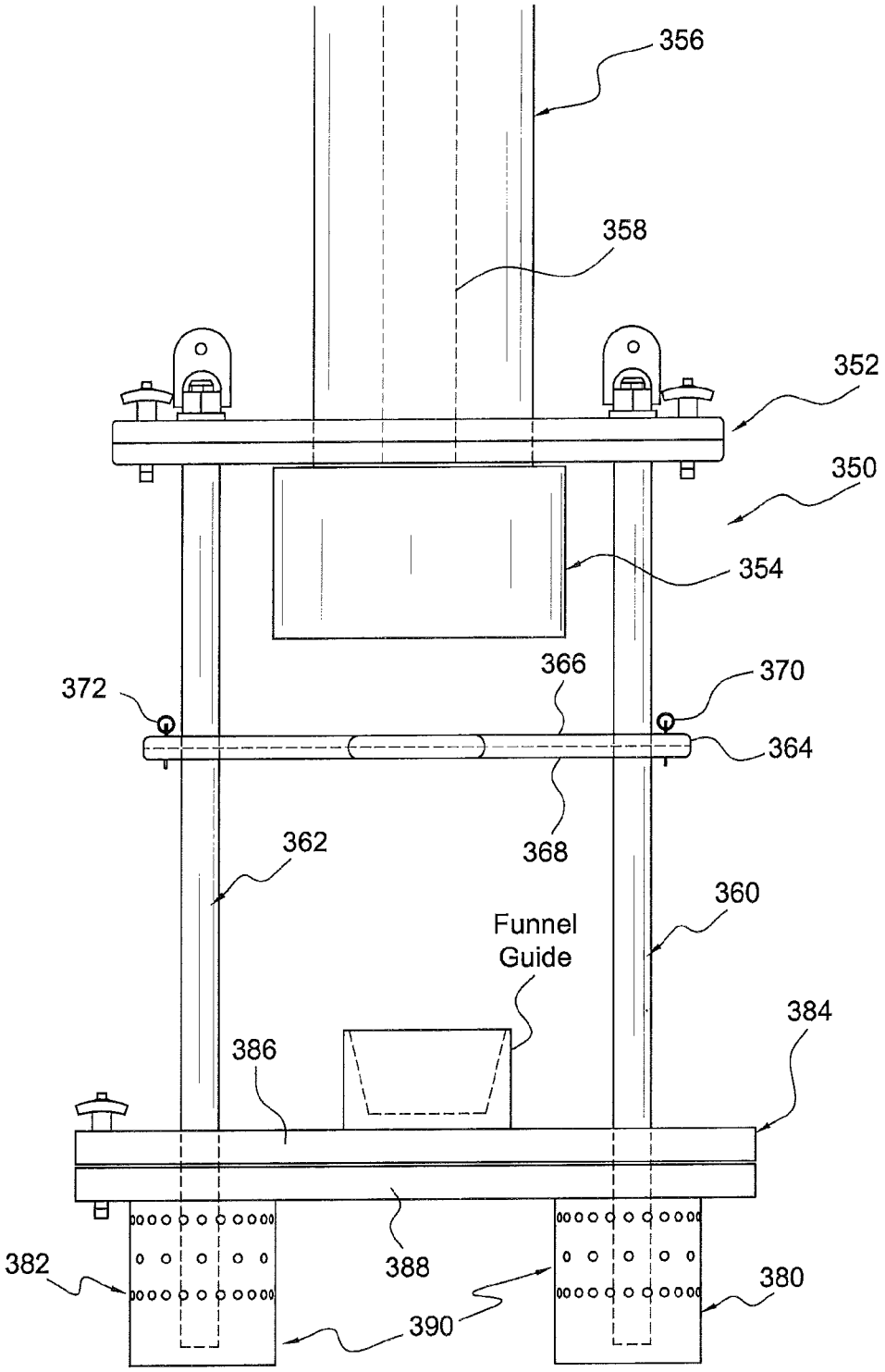
FIGS. 37 and 38 are diagrammatic illustrations of additional embodiments of the invention.

Still another embodiment of the invention facilitates a more permanent installation at a well head, and is a modification of the embodiment described with respect to FIGS. 9-12. In this case, as illustrated diagrammatically in FIGS. 37 and 38, a tool catcher 350 is constructed in accordance with the prior embodiments in that it includes a collar clamp 352 engaging the top of a collar portion 354 of a lubricator housing 356 through which a tool string 358 passes. The collar clamp secures depending support rods 360 and 362 on which an entry guide 364 is mounted to direct a tool string through the catcher assembly. In this case, the guide 364 is a two-piece unit, having two matching halves 366 and 368 with overlapping ears (not shown) that receive pins 370 and 372 that can be removed to allow removal of the entry guide or that can form hinges to allow the guide to remain on the rods but be swung out of the way of a tool string if desired. The entry guide may be vertically positioned on the rods by pins engaging corresponding apertures in the rods, as previously described, or held in place by a rod clamp, to be described.

Secured at the bottom of the rods is a pair of crush cylinders 380 and 382, as previously described, and a rotatable catcher plate assembly 384 that has two openable and closable catch plates 386 and 388, as previously described, resting on the tops of the crush cylinders. Since this embodiment is intended to be left on the well head, the distance 390 between the crush cylinders, and thus the distance between the rods 360 and 362, must be wider than the well head connection so that well equipment can be straddled by the tool catcher. This also requires a correspondingly wider collar clamp.

Figure 38:
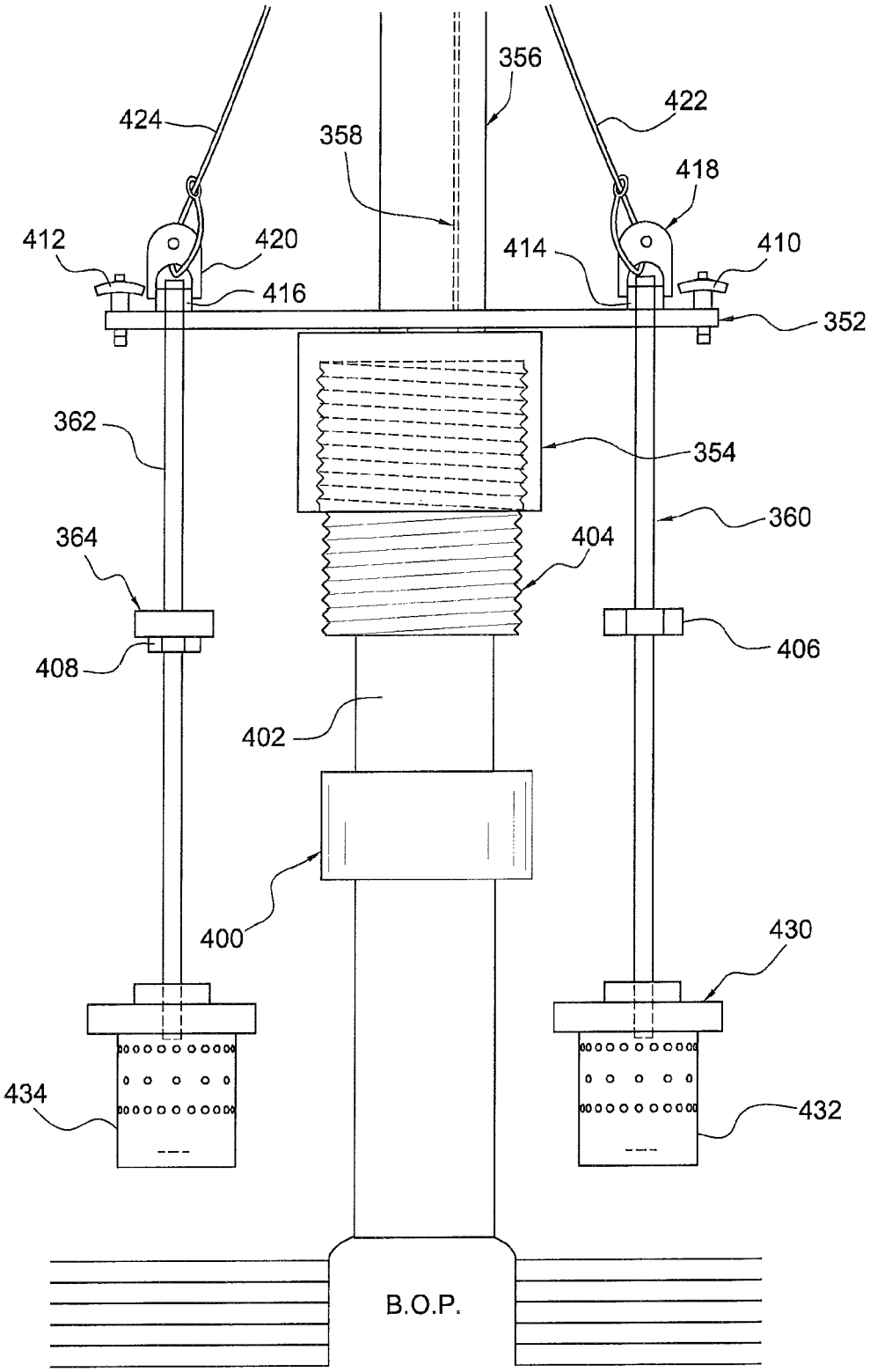

FIG. 38 illustrates the tool catcher lowered down over a well head 400 incorporating a casing 402 having top threads for receiving the collar 354. As shown, the entry guide 364 is opened to allow passage of the well head, with the guide being vertically positioned on the rods by rod clamps 406 and 408. As previously, the collar clamp 352 rests on collar 354; this may be a hinged two-part collar secured about the housing 356 by pins 410 and 412 as in prior embodiments, or may be a bolted clamp, also as previously described. As in prior embodiments, the rods 360 and 362 are secured in the collar clamp by lifting nuts 414 and 416, and corresponding lifting rings 418 and 420, to allow the assembly to be lifted and secured by lift cables 422 and 424. In this case, the catcher plate assembly has been opened and moved aside, and the spacing of the rods allows the crush cylinders 432 and 434 at the bottom of rods 360 and 362 to pass on either side of the well head.

The foregoing describes preferred embodiments of drill string trapping apparatus and methods, and it is believed that other modifications, variations and changes will be suggested to those skilled in the art in view of the teachings set forth herein. It is to be understood that all such variations, modifications and changes are believed to fall within the scope of the present invention as set forth in the following claims.

What is claimed is:

1. An external tool string trap assembly for mounting on a bottom end of a drilling tool string housing, comprising:

a collar clamp mounted on corresponding top ends of first and second vertical rails that are laterally spaced apart, said collar clamp being securable to said tool string housing;

first and second crush cylinders affixed to corresponding bottom ends of said first and second vertical rails;

an openable and closable catcher plate assembly pivotally and slideably attached to said first and second vertical rails and supported by said first and second crush cylinders, wherein said openable and closable catcher plate assembly permits or restricts insertion of a tool string when said catcher plate assembly is opened or closed, respectively;

a funnel receptacle mounted on said catcher plate assembly, and movable into coaxial alignment along with the tool string housing when the catcher plate assembly is moved from an open to closed position, wherein when said tool string falls and strikes said funnel receptacle with a force, said catcher plate assembly slides down on said first and second vertical rails such that kinetic energy dissipated by said falling tool string is directed into said first and second crush cylinders by way of said catcher plate assembly, and is absorbed by said first and second crush cylinders, and wherein further the first and second crush cylinders are affixed to the corresponding bottom ends of the first and second vertical rails by corresponding connecting rods and secured to the respective rod with a corresponding nut.

2. The assembly of claim 1, further including a debris shield surrounding said funnel receptacle when the catcher plate assembly is closed.

3. The assembly of claim 1, wherein said collar clamp includes first and second clamp portions hingedly connected to each other to close around said housing for mounting and removing said assembly.

4. The assembly of claim 1, wherein said catcher plate assembly includes upper and lower plates each pivotably mounted at one end of one of said rails and engagable with one end of the other of said rails when in the closed position.

5. The assembly of claim 1, further including a guide plate mounted on said first and second vertical rails between said collar clamp and said catcher plate assembly, and coaxially aligned with said tool string housing.

6. The assembly of claim 5, wherein said collar clamp is affixed around said housing for mounting said assembly, and wherein said guide plate comprises a pair of opposed plate segments hingedly mounted on said rails.

7. The assembly of claim 6, wherein said first and second vertical rails are separated by a distance to allow said first and second crush cylinders to pass on either side of a well head when said external tool string trap assembly is lowered down on said well head.

8. The assembly of claim 1, wherein said crush cylinders consist of top and bottom crush washers that engage top and bottom walls of a cylindrical sacrificial energy absorbing cartridge, wherein said cartridge may be a crushable material that is rigid to support said assembly on said corresponding first and second vertical rails under normal conditions, and is destroyed by absorbing said kinetic energy of said falling tool string.

9. The assembly of claim 1, wherein said funnel receptacle has a conical inner surface to direct said force to a center of said catcher plate assembly to distribute said force on said first and second crush cylinders.

10. The assembly of claim 1 further comprising a cylindrical containment shield around the crush cylinders to prevent debris from the crush cylinders from scattering when the cylinders are crushed.

11. The assembly of claim 10 wherein the containment shield contains spaced rows of perforations to provide pressure release during a crushing operation.

12. An external tool string trap assembly for mounting on a bottom end of a drilling tool string housing, comprising:

a collar mounted on corresponding top ends of first and second vertical rails that are laterally spaced apart, said collar clamp being securable to said tool string housing;

first and second crush cylinders affixed to corresponding bottom ends of said first and second vertical rails;

an openable and closable catcher plate assembly pivotally and slideably attached to said first and second vertical rails and supported by said first and second crush cylinders, wherein said openable and closable catcher plate assembly permits or restricts insertion of a tool string when said catcher plate assembly is opened or closed, respectively; and a funnel receptacle mounted on said catcher plate assembly, and movable into coaxial alignment along with the tool string housing when the catcher plate assembly is closed, wherein when said tool string falls and strikes said funnel receptacle with a force, said catcher plate assembly slides down on said first and second vertical rails such that kinetic energy dissipated by said falling tool string is directed into said first and second crush cylinders by way of said catcher plate assembly, and is absorbed by said first and second crush cylinders;

wherein further, said crush cylinders consist of top and bottom crush washers that engage top and bottom walls of a cylindrical sacrificial energy absorbing cartridge, wherein said cartridge may be a crushable material that is rigid to support said assembly on said corresponding first and second vertical rails under normal conditions, and is destroyed by absorbing said kinetic energy of said falling tool string.

* * * * *